United States Patent [19]

Davis, Jr. et al.

[11] 4,010,630

[45] Mar. 8, 1977

[54] HYDRAULIC ACTUATED POWER TOOL

[75] Inventors: Samuel B. Davis, Jr., New Galilee; Donald G. Lordo, Beaver Falls, both of Pa.

[73] Assignee: Textron, Inc., Providence, R.I.

[22] Filed: Apr. 8, 1976

[21] Appl. No.: 674,967

[52] U.S. Cl. ..... 72/391; 72/453.17; 91/411 A; 92/111

[51] Int. Cl.[2] ..... B21J 15/34

[58] Field of Search ..... 72/391, 453.17; 91/411 A; 92/111

[56] References Cited

UNITED STATES PATENTS

| | | | |
|---|---|---|---|
| 1,612,779 | 12/1926 | Mercer | 173/73 |
| 2,354,841 | 8/1944 | Shaff | 91/411 A |
| 3,329,000 | 7/1967 | Schwab | 72/391 |
| 3,430,539 | 3/1969 | Freeman | 92/111 |
| 3,446,509 | 5/1969 | Colosimo | 72/391 |
| 3,457,840 | 7/1969 | Grimes | 92/111 |
| 3,485,141 | 12/1969 | Ott | 92/111 |
| 3,534,580 | 10/1970 | Chirco | 72/391 |
| 3,554,088 | 1/1971 | Bruyn | 92/111 |
| 3,752,040 | 8/1973 | Pawloski | 91/411 A |

*Primary Examiner*—C.W. Lanham
*Assistant Examiner*—Gene P. Crosby
*Attorney, Agent, or Firm*—Webb, Burden, Robinson & Webb

[57] ABSTRACT

The hydraulic actuated power tool includes a barrel having an internal, annular bulkhead separating the barrel into two cylinder chambers. A single piston shaft having two pistons thereon operates within the cylinders of the barrel. One of the pistons is located intermediate the shaft ends and the other is positioned at the terminal end of the piston rod. This latter piston serves as the back wall for the rear cylinder chamber. The piston shaft is ported so that in the power stroke both pistons are being urged rearward, whereas in the return stroke only the forward piston is being acted upon. The porting includes a transverse port extending across the piston shaft and a longitudinal port connecting midway of the transverse port and extending along the piston shaft and terminating in a bifurcated passageway which extends through the forward piston. A floating front wall makes up the end wall of the forward cylinder. The rear piston is attached at the terminal end of the piston shaft through a split retainer ring.

8 Claims, 10 Drawing Figures

HYDRAULIC ACTUATED POWER TOOL

FIELD OF THE INVENTION

Our invention relates to high power setting tools and, more particularly, to hydraulic actuated tools having multiple, coaxial pistons and utilized to set large structural fasteners such as lockbolts and the like.

DESCRIPTION OF THE PRIOR ART

Large installation tools are presently used to set structural fasteners such as lockbolts. These installation tools presently include a single, large piston which will deliver 50,000 or 60,000 pounds of force from a hydraulic pump having an 8500 psi rating. While such a tool will properly set a lockbolt, the tool size necessary to accommodate the requisite piston surface area is not compatible with present highrise construction and the like where rows of fasteners must be installed in difficult to reach, low clearance areas as between closely positioned structural members. Not only is the diameter of the installation tool critical, but the length may also be in certain existing construction techniques. In addition, the tools in use for such applications are heavy and cumbersome to operate and, therefore, operator fatigue becomes a problem and productivity often decreases over a working day.

Multiple, coaxial pistons are known, but they have not been applied to hydraulic setting tools for structural fasteners. The reasons being that the length of the tool greatly increases with a plurality of coaxial pistons and cylinders and porting of the oil becomes a real problem. Representative multipiston tools of one sort or another are illustrated in U.S. Pat. Nos. 1,612,779; 3,430,539; 3,485,141; 3,457,840; 3,554,088 and 3,752,040.

SUMMARY OF THE INVENTION

Our installation tool makes structural fastener installations such as lockbolts more accessible than with existing tools. This is accomplished by utilizing a substantially lighter, low profile tool which provides the same installation forces as the existing tools. The lower profile overcomes many of the restricted clearance problems encountered heretofore and the lighter weight overcomes or reduces operator fatigue thereby adding to overall productivity. The reduction in diameter of the tool is accomplished without any detrimental increase in the effective length of the tool.

Our invention combines a novel porting system with a novel piston connection and cylinder construction. Our invention is a hydraulic actuated power tool in which the barrel has an internal, annular bulkhead separating it into two cylinders. A single piston shaft having a first piston integrally formed intermittent the piston shaft ends and a second piston mounted on the end of the piston shaft is operable within the cylinder chambers formed in the barrel. The mounted piston serves as the end wall for one piston chamber and a floating annular seal retainer functions as the end wall in the remaining chamber. A transverse port extends through the piston shaft and a longitudinal port connects midway of the transverse port, extends along the piston shaft and terminates in bifurcated legs which extend through the first piston and communicate with the forward chamber. The mounted piston is connected through a split retainer ring so that it is at the extreme end thereof. During the power stroke, forces are acting upon both pistons whereas in the return stroke, the forces act on only the forward piston. An ejector for removing a fastener pintail is also provided.

DESCRIPTION OF THE PREFERRED EMBODIMENTS

Figure 1:
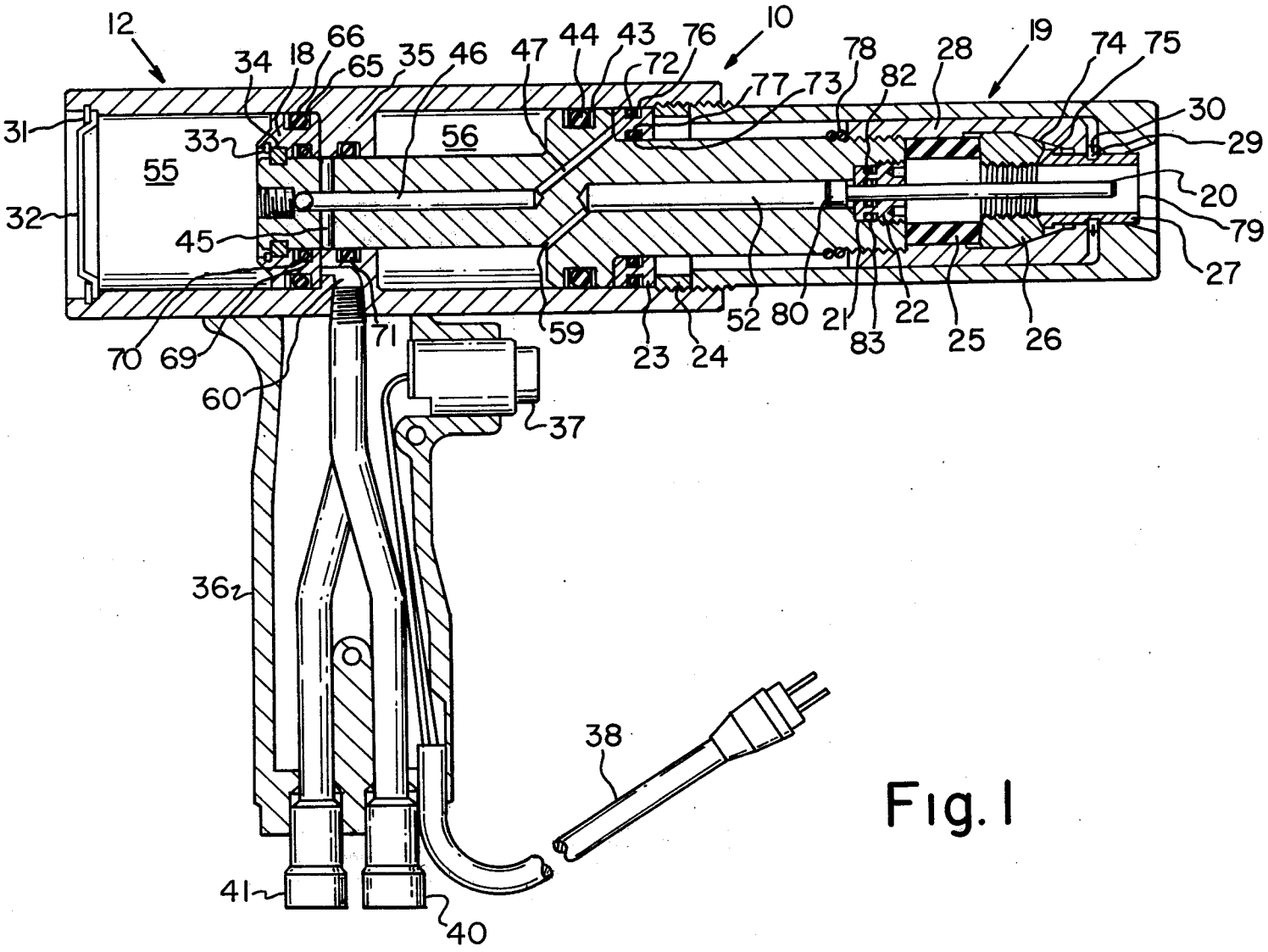
FIG. 1 is a section through our power actuated installation tool taken along the longitudinal center line thereof.
Figure 2:
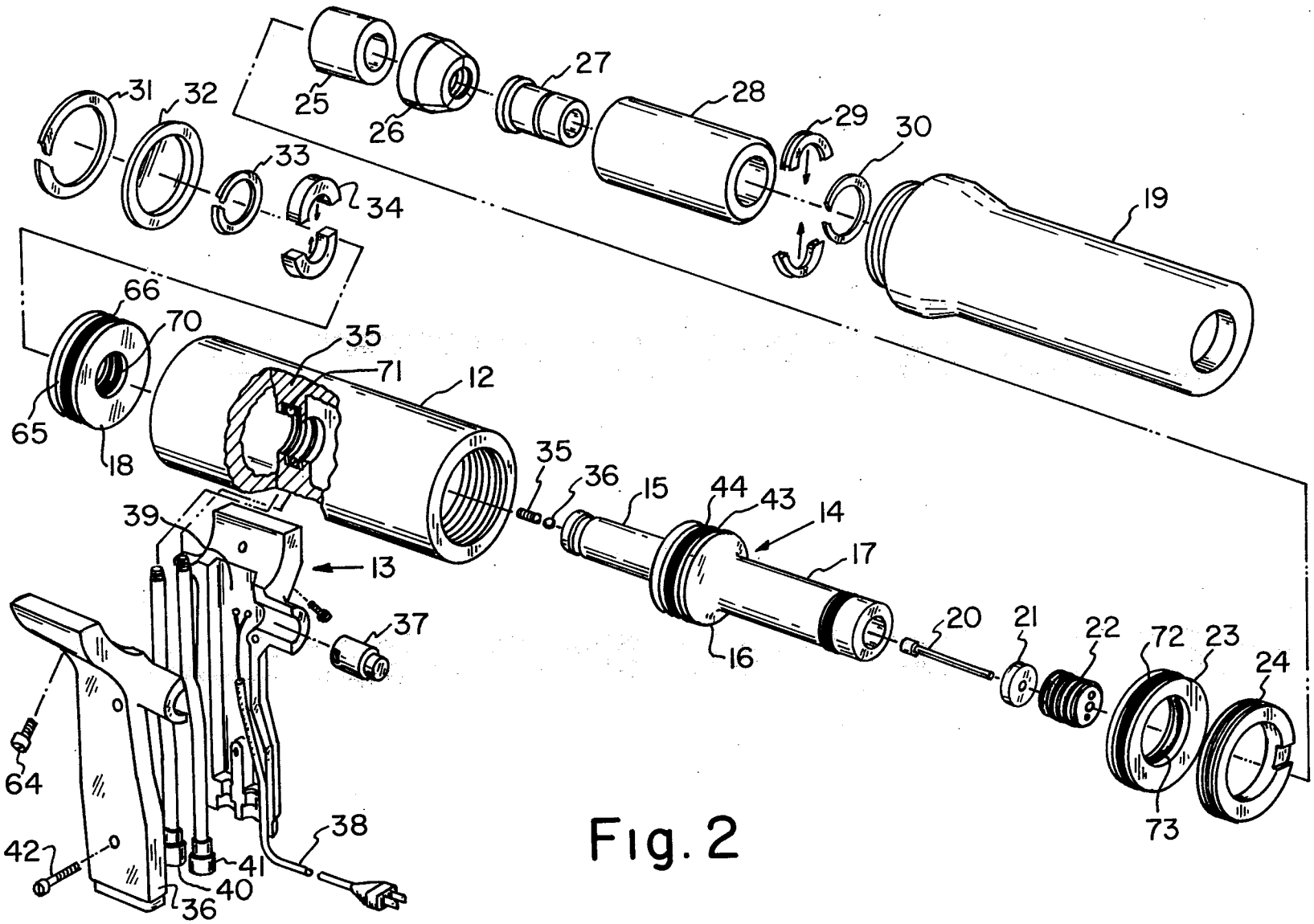
FIG. 2 is an exploded view of the installation tool.

The major exposed components of our installation tool, generally designated 10, include a barrel 12 connected to a handle 13 and an anvil 19 which is threadably secured to an end of the barrel 12, FIGS. 1 and 2.

Figure 3:
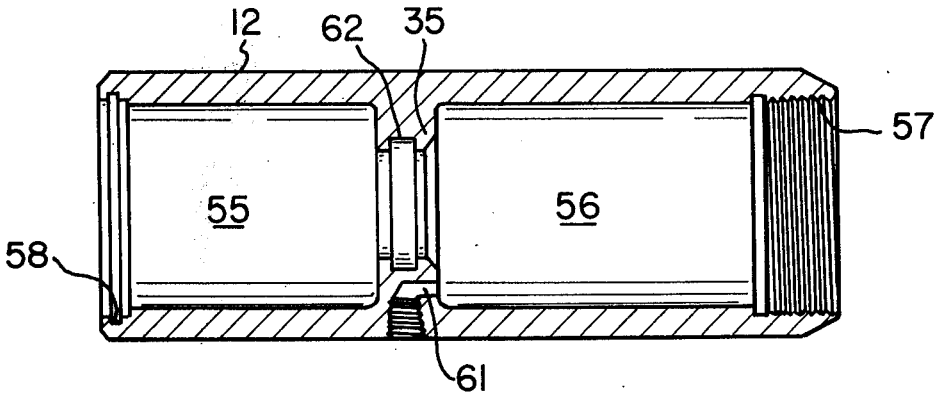
FIG. 3 is a section through the barrel taken along the longitudinal center line.
Figure 7:
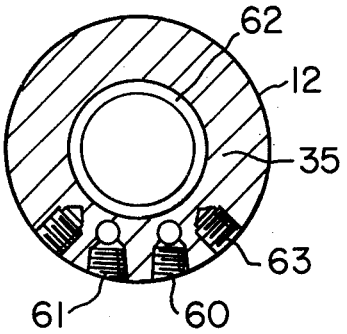
FIG. 7 is a section taken along section lines VII—VII of FIG. 6.
Figure 6:
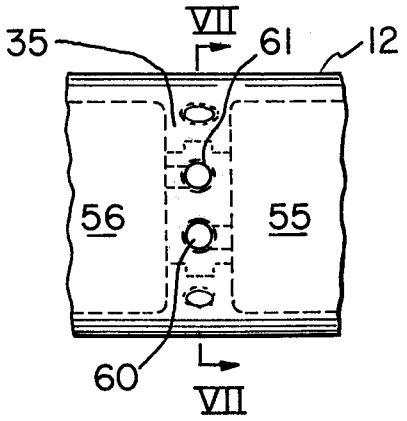
FIG. 6 is an elevation of the portion of the barrel in the area of the center bulkhead.

The barrel 12 is cylindrical and includes an internal, annular flange, or bulkhead 35, positioned intermediate the ends of the barrel 12 to divide it into a forward, internal chamber 56 and a rearward, internal chamber 55, FIG. 3. The forward end of chamber 56 terminates in internal threads 57 which accommodate the threaded anvil 19. The rearward chamber 55 terminates in an annular, stepped groove 58 which accommodates a dust cover 32 held in place by a snap ring 33, FIG. 2. The center bulkhead 35 includes an annular interior groove 62 to accommodate an O-ring 71, FIGS. 1–3. Bulkhead 35 further includes a threaded inlet port 60 which communicates with chamber 55 and an exit port 61 which communicates with chamber 56, FIGS. 6 and 7. Threaded, blind taps 63 extend into the barrel 12 on either side of the ports 60 and 61, FIG. 7.

Handle 13 is made up of split handle sides 36 which are joined together by bolts 42 and are connected to the barrel 12 by bolts 64 which thread into the blind, threaded taps 63, FIG. 2. An inlet pipe 40 having an appropriate hose fitting at one end extends through the handle 13 and threadably engages inlet port 60 in the bulkhead 35. In the same manner, outlet pipe 41 having an appropriate hose fitting extends through the handle 13 and threadably connects to exit port 61. Pipes 40 and 41 are adapted to connect to an appropriate hydraulic pump and reservoir system (not shown). A trigger switch 37 secured to handle 13 electrically connects through cord 38 with the pump system to trigger the pump which activates the tool 10, FIGS. 1 and 2.

Figure 5:
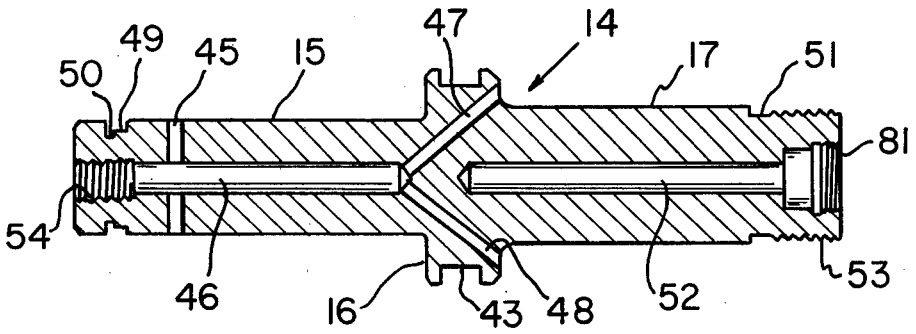
FIG. 5 is a section through the piston shaft taken along lines V—V of FIG. 4.
Figure 4:
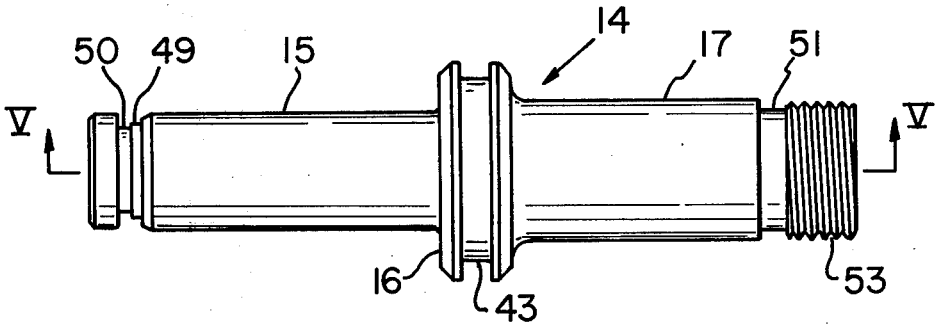
FIG. 4 is an elevation of the piston shaft.

The piston shaft 14 includes an integrally mounted piston 16 intermediate the piston shaft ends which divides the piston shaft 14 into piston rod 15 and piston rod 17, FIGS. 4 and 5. The distal end of piston rod 15 includes an annular, undercut relief groove 50 adjacent an annular recess 49, for mounting piston 18, as will be described hereinafter. A transverse port 45 extends completely through the piston rod 15, FIGS. 1 and 5. A longitudinal port 46 is bored into piston rod 15 and extends the length thereof. Port 46 is bifurcated at its terminus into legs 47 and 48 which extend angularly outward from port 46 and extend through the piston 16 to communicate with chamber 56. Port 46 is threaded at its entry end by internal threads 54 so as to be properly shut off by plug 35 and ball 36 which act as a complete seal to the entry end opening, FIG. 2. Piston 16 includes an external annular recess 43 to accommodate O-ring 44, FIGS. 1 and 2. A longitudinal chamber 52 is bored into piston shaft 14 so as to extend the length of piston rod 17. The distal end of rod 17 includes external threads 53 to accommodate collet 28 and the chamber 52 includes internal tapped threads 81 to accommodate seal retainer 22 to be described hereinafter.

Piston shaft 14 is positioned within barrel 12 so that piston 16 is operable in chamber 56 and piston rod 15 extends through annular bulkhead 35 into chamber 55.

Figure 8:
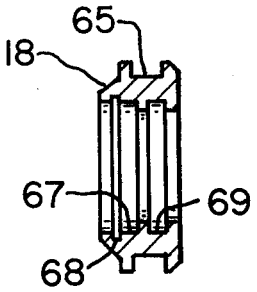
FIG. 8 is a section taken through the rear piston.

Piston 18 is mounted on the extreme distal end of piston rod 15, FIGS. 1 and 2. The piston which is annular has a perimetral, annular groove 65 which accommodates an O-ring 66. Along the internal diameter of the annular piston 18 is a recess 67 which accommodates the split retainer ring 34 and an adjacent groove 68 which accommodates the snap ring 33. An annular groove 69 to accommodate O-ring 70 is also positioned along the interior diameter of annular piston 18, FIGS. 1 and 8.

Figure 9:
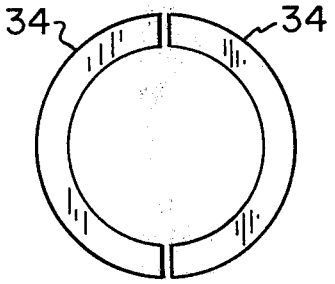
FIG. 9 is an enlarged elevation of the split retainer ring.
Figure 10:
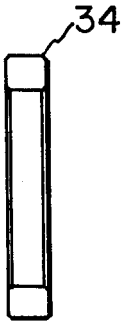
FIG. 10 is a side elevation of the split retainer ring of FIG. 9.

The split retainer ring is made up of two semicircular sections 34, FIGS. 9 and 10. After the piston 18 is positioned on the piston rod 15, the split rings 34 are placed in groove 49 on the piston shaft 15 and the piston 18 is slid thereover so that the rings 34 are also positioned in retainer recess 67. Snap ring 33 is then positioned in groove 68 so as to keep the piston 18 from moving off of the end of the piston rod 15. The effect of this connection is to place the piston 18 at the very end of rod 15 and thereby eliminate the standard threaded shaft and lock nut connection normally utilized with multipiston tools and which adds to the length of the tool.

Positioned within chamber 56 and about piston rod 17 is an annular seal retainer or floating wall 23, FIG. 1. Floating wall 23 forms the end wall for chamber 56. End wall 23 is retained from forward movement by threaded spanner nut 24 which is annular and which threadably connects within the end of barrel 12. Wall 23 has an outer, annular groove 76 which accommodates O-ring 72 and an inner annular groove 77 which accommodates O-ring 73 to seal respectively against the barrel 12 and the piston rod 17. As stated hereinbefore, anvil 19 likewise threads into threads 57 of barrel 12.

Collet 28 threads onto external threads 53 provided at the distal end of piston rod 17 and the collet is further held in adjustment by frictional engagement with O-rings 78 placed in groove 51 adjacent the threads 53, FIGS. 1, 2 and 4. Collet 28 terminates in a forward, internal frustoconical surface 74 which accommodates three jaws 26 which are slidable therealong. Positioned between jaws 26 and the end surface of piston rod 17 is an elastomer bushing 25 which maintains tension on and holds position of the jaws 26. Positioned forward of jaws 26 is an ejector sleeve 27 having an annular land 75 at one end and an annular groove intermittent its ends to accommodate a split retainer 29 and a snap ring 30, FIGS. 1 and 2. Ejector sleeve 27 extends out into the opening 79 at the forward end of anvil 19. Jaws 26 can move forward against the ejector sleeve 27 until the land 75 thereof engages the frustoconical surface 74 of collet 28 and jaws 26 can move rearward until restrained by elastomer bushings 25.

Ejector pin 20, which terminates in a piston 80, is slidably positioned in chamber 52 of piston rod 17, FIGS. 1 and 2. Ejector pin 20 extends through washer 21 and seal retainer 22 which is threaded into the internal threads 81 of piston rod 17. Seal retainer 22 is grooved along its outer and inner surfaces to accommodate O-rings 82 and 83, respectively, FIG. 1.

A brief explanation of a lockbolt (not shown) will assist in an understanding of how the tool operates. The lockbolt has a head and a threaded shank. A collar is positioned over the shank after the shank is inserted through the workpieces. The collar is swaged to the shank by the tool after the workpieces are clamped together between the head and the collar and thereafter the remaining shank (called pintail) is broken off by the tool at a breaknotch located adjacent the collar.

The operation of our hydraulic, actuated power tool 10 is as follows. The pistons 18 and 16 are shown in their forwardmost position in FIG. 1 prior to activation into a power stroke. Activation of the trigger switch 37 causes the hydraulic pump (not shown) to direct oil through inlet pipe 40 and into port 60. The initial surge of oil is directed against piston 18 causing it to move rearward in chamber 55. Simultaneously transverse port 45 receives oil which is then caused to flow into longitudinal port 46. The oil exits longitudinal port 46 through the legs 47 and 48 so as to impinge upon floating forward wall 23 which can move no further than the stop created by spanner nut 24. Since floating forward wall 23 cannot go forward, the oil is caused to impinge upon piston 16 to cause it to also move rearward in chamber 56. As the two pistons 18 and 16 move rearward, the oil in chamber 56 in advance of piston 16 freely flows thereout through exit port 61 and outlet pipe 41. During this rearward movement, collet 28 causes jaws 26 which have gripped the fastener to also move rearward as the anvil 19 operates against the lockbolt collar. After the fastener is properly set, the pintail or expendable end of the lockbolt is broken off and is held in place by the jaws 26.

Thereafter, the trigger switch is released to switch the hydraulic pump so that oil now forceably enters pipe 41 and port 61 to impinge against piston 16 with the oil in chambers 55 and 56 free to feed back into the pump reservoir through pipe 40. At the same time, oil enters through port 59 into chamber 52 and acts against piston 80 to cause ejector pin 20 to move against the pintail held by the jaws 26. When collet 28 reaches its forwardmost position, ejector sleeve 27 is repositioned so as to free the jaw 26 from the pintail, which is then free to be ejected. The elastomer bushings 25, having been compressed by jaws 26, act to maintain the orientation of the jaws as the jaws are opened to release the pintail. In other words, in the power stroke, oil is acting upon both pistons, whereas in the return and eject strokes, the oil is acting upon only one of the pistons.

With the tool at rest the ejector sleeve 27 is retained within the anvil 19 by the split retainer 29 and snap ring 30 on the one side and the integral land 75 acting against the frustoconical surface 74 of collet 28. After the workpieces are clamped together and the lockbolt is pulled into the tool, the continuing rearward movement breaks off the lockbolt pintail. As chamber 52 is being pressurized, the ejector pin 20 is driven forward. The ejector sleeve 27 first hits the installed collar and pushes the tool from the fastener and then releases the jaws 26 from the pintail as previously described to permit the ejector pin 20 to push the pintail out. This method of removing the pintail is not novel, but the utilization of the elastomer bushing 25 is believed new, since it replaces a multipiece assembly in the prior art tools.

By designing the piston cylinder diameter as close to the nose assembly diameter as possible, a very low profile installation tool is provided. At the same time, by securing the piston at the distal end of the piston shaft through the split retainer ring, the overall length of the tool is not sacrificed. The result is a lightweight tool capable of setting structural fasteners in modern construction where restricted clearance seems to be the rule rather than the exception.

We claim:

1. A hydraulic actuated tool comprising:

A. a barrel having an internal, annular bulkhead separating the barrel into a front cylinder and a rear cylinder, said bulkhead including a first port directed into the front cylinder and a second port directed into the rear cylinder;

B. a handle depending from the barrel in the area of the bulkhead;

C. a piston shaft positioned in the barrel and having a first piston integrally formed intermediate the piston shaft ends to form a first piston rod positioned with the first piston in the front cylinder and a second piston rod extending through the bulkhead into the rear cylinder, said second piston rod having a transverse port extending therethrough and a longitudinal port connecting midway of the transverse port and extending along the second piston rod and terminating in a bifurcated passageway, each leg of the passageway extending angularly outward from the longitudinal port and clear through the first piston;

D. a second piston mounted at the distal end of said second piston rod, said piston forming the end wall of the rear cylinder;

E. front wall means positioned within the barrel to define the end wall of the first cylinder;

F. a fastener driving assembly secured to the barrel including means associated with the first piston rod to grip a fastener;

G. a first and second pipe extending through the handle, said first pipe connected to the first port and said second pipe connected to the second port;

whereby a first activation of the tool transmits oil through the second port and against the second piston and simultaneously therewith through the transverse and longitudinal ports against the front wall means to simultaneously force the two pistons rearward and a second activation transmits oil through the first port and against the first piston, said oil in the first and second chambers exiting through the second pipe.

2. The tool of claim 1, said second piston rod having a groove therein adjacent the distal end, said second piston having an internal groove in alignment with the piston rod groove and a split retainer ring, said ring comprising two semicircular sections, each section being positioned within the internal groove and the piston rod groove.

3. The tool of claim 2, including a snap ring adjacent the split retainer ring.

4. The tool of claim 1, said front wall means being annular and freely mounted within the barrel about the second piston rod and including an internal and external annular groove to accommodate seals and stop means connected within the barrel to limit the forward movement of the front wall means.

5. The tool of claim 1, said first piston rod including an elongated chamber extending throughout the first piston rod in axial and spaced alignment from the longitudinal port, said chamber communicating with the front cylinder through a port extending through the first piston and an ejection pin operable within the chamber to eject a fastener from the grip means after setting.

6. The tool of claim 1, said fastener driving assembly comprising an anvil threadably mounted to the barrel, a collet having a frustoconical interior surface threadably mounted to the first piston rod, jaws having rearward and forward surfaces and positioned within the collet for slidable engagement with said interior surface, an elastomer bushing positioned between the first piston rod and the rearward surface of the jaws and an ejector sleeve positioned adjacent the forward surface of the jaws.

7. The tool of claim 6, said ejector sleeve including an annular land which, in a forward position, engages said interior surface to retain the sleeve within the anvil.

8. A hydraulic actuated power installation tool comprising:

A. a barrel having an internal, annular bulkhead separating the barrel into a front cylinder and a rear cylinder, said bulkhead including a first port directed into the front cylinder and a second port directed into the rear cylinder;

B. a handle depending from the barrel in the area of the bulkhead;

C. a piston shaft positioned in the barrel and having a first piston integrally formed intermediate the piston shaft ends to form a first piston rod positioned with the first piston in the front cylinder and a second piston rod extending through the bulkhead into the rear cylinder, said second piston rod having a transverse port extending therethrough and a longitudinal port connecting midway of the transverse port and extending along the second piston rod and terminating in a bifurcated passageway, each leg of the passageway extending angularly outward from the longitudinal port and clear through the first piston, said second piston rod having a stepped groove therein adjacent the distal end and said first piston rod having an elongated blind chamber communicating with the first cylinder through a port extending through the first piston;

D. a second piston having an annular, internal groove in alignment with the stepped groove, said piston forming the end wall of the rear cylinder;

E. a split retainer ring positioned in the internal groove and the stepped groove and a snap ring positioned in the stepped groove to retain the second piston on the second piston rod;

F. an annular freely moving wall positioned within the barrel about the second piston rod to define the end wall of the first cylinder;

G. a first and second pipe extending through the handle, said first pipe connected to the first port and said second pipe connected to the second port; and H. a driving assembly mounted to the end of the first piston and comprising a collet having a frustoconical interior surface, an elastomer bushing positioned in the collet adjacent the first piston rod, jaw members positioned adjacent the bushing and slidably operable along said interior surface, an ejector sleeve adjacent the jaws and retained in the collet and an ejector pin operable in the blind chamber and extending outward therefrom to remove a fastener member from the jaws.

* * * * *